United States Patent [19]

Banz et al.

[11] 3,991,998

[45] Nov. 16, 1976

[54] DOCUMENT FEED SYSTEM

[75] Inventors: Derrald M. Banz, Wheaton, Md.; Robert E. Springer, Woodbridge, Va.

[73] Assignee: Decision Data Computer Corporation, Horsham, Pa.

[22] Filed: May 27, 1975

[21] Appl. No.: 581,263

[52] U.S. Cl. ..... 271/125; 271/167

[51] Int. Cl.[2] ..... B65H 3/46

[58] Field of Search ..... 271/34, 35, 122, 124, 271/125, 138, 167

[56] References Cited

UNITED STATES PATENTS

| | | | |
|---|---|---|---|
| 1,214,474 | 1/1917 | Jones | 271/34 |
| 2,104,630 | 1/1938 | Zahn | 271/122 |
| 2,140,170 | 12/1938 | Rouan | 271/125 |
| 3,210,073 | 10/1965 | Godlewski | 271/125 |
| 3,545,742 | 12/1970 | Muller et al. | 271/122 |
| 3,795,395 | 3/1974 | Ransom et al. | 271/125 |

*Primary Examiner*—Robert W. Saifer

*Attorney, Agent, or Firm*—Synnestvedt & Lechner

[57] ABSTRACT

A document feed mechanism is disclosed for feeding documents from the bottom of a stack. Sheet separating rolls prevent the feeding of more than one sheet at a time through a nip formed by the separating rolls and feed rolls. Wear compensation means functions to uniformly distribute wear about the cicumference of the separation rolls. The wear compensation means additionally provides for axial shifting of the separator rolls relative to the feed rolls so that a constant gap or nip is maintained. Simplified means for adjusting the gap are also disclosed. The feed mechanism will accept documents having a relatively wide range of thicknesses without adjustment.

6 Claims, 4 Drawing Figures

4
13
12
3
2
40
42
39
10
49
38
45
48
51
17
28
37
30
52
44
11
43
26
22
17a
3
36
53
23
13a
18a
18b
19
18
41
27
25
25
32
29
35
34
29a
31
24
27a
33
2
25
4

40
39
40
39
48
38
49
38
48
38
49
46
50
28
28
28
52
45
43
36
43
43
47
44
44
44
36
53
27a
41
31
27
27
35A
35A
35

13
46
51
52
41
53
13a
33
31
32
23
27
35a
28
13a
35
38
49
36
28
27
13a
35a
38
49
36
28
27
24
23
25
45
47
50
27a
34

DOCUMENT FEED SYSTEM

BACKGROUND OF THE INVENTION

This invention relates to document feeding equipment for stripping and feeding documents one at a time from a stack of documents.

Although not limited in its application thereto, the document feeding equipment of the present invention is especially adapted for use in the rapid feeding of documents to a read station for reading by character recognition equipment and for further processing.

Various types of document feeders for feeding documents from the bottom or end of a stack are known in the art. With known prior devices, difficulties are encountered in the feed of documents of a relatively wide range of thicknesses over prolonged periods of time. Many such prior art devices are well adapted for reliably feeding one type of document such as a punched card or other document of constant thickness but are not well suited for the feeding of very thin documents, or documents whose thicknesses vary to an appreciable degree or documents which tend to cling together when they are fed. Moreover, many of the prior devices known to us which may accept documents of a range of thicknesses have no effective means for compensating for wear induced changes in dimensions and require relatively frequent adjustment or replacement of cricital parts such as feed rolls and the like.

As indicated above, the present invention is intended for use for feeding documents to a reader in optical character recognition equipment. It is desirable that such a device be capable on the one hand of feeding tissue paper thin documents such as airline or train tickets having a thickness of about 0.002 inches, and on the other hand being able to accommodate relatively thick card stock of the kind used for punched cards. It is desired that such documents be fed relatively rapidly and to the maximum extent possible, without operator intervention. It is also extremely desirable that the mechanism be capable of feeding documents over prolonged periods of time without the need for special servicing by skilled service personnel.

Particularly troublesome problems with apparatus of the kind described obviously arises when two documents are fed at the same time. Double feeding of documents means that information contained on one of the documents is not read by the optical character recognition equipment and if this happens with any frequency, reliability of the entire system is destroyed for data processing purposes. Detection of errors caused by double feeding is very difficult to detect and even when detected it is time consuming and costly since it usually requires some manual intervention on the part of the operator.

Examples of prior art feeders are shown in Rouan et al U.S. Pat. No. 2,273,287, Oaten U.S. Pat. No. 3,525,518 and Kolibas U.S. Pat. No. 3,838,851.

OBJECTS OF THE INVENTION

With the foregoing in view, an important object of the invention is the provision of a feed means for feeding documents from a stack, which prevents the feeding of two documents simultaneously.

A further object of the invention is the provision of a feeding mechanism for feeding documents from a stack having provision for feeding documents of various thicknesses without the need for adjustment of the feed mechanism.

A still further object is the provision of feed mechanism having a feed roll and a stationary separator roll and means for automatically indexing the separator roll so as to distribute wear around the circumference of the separator roll.

A still further object of the invention is the provision in document feed apparatus having a feed roll and a stationary separator roll, of means for maintaining a feed gap or throat of substantially constant dimension despite wear induced variations on the surface of the separator roll.

The foregoing and other objects of the invention are achieved by means of a relatively soft feed means engageable with the exposed surface of each sheet at the end of the stack, which feed means is movable to serially advance sheets through a throat gap formed by the feed means and a separator roll adjacent the feed means. The separator roll is formed of a relatively soft material having a high coefficient of friction and frictionally retards the feed of of any second sheet fed simultaneously with the sheet being advanced by the feed means. Wear compensation means for the separator roll comprises means for rotating the separator roll, and means for axially displacing the separator roll relatively to the feed means along a path which maintains a throat gap of substantially constant dimension for prolonged periods of time.

Also provided, in a device having a plurality of separator rolls, is means for independently adjusting each of a plurality of separator rolls relative to the feed means whereby a feed gap of constant dimension is established, coupled with means for adjusting the separator rolls in unison whereby the gap can be adjusted by the operator when documents which are appreciably thicker or thinner than documents previously used are to be fed. The separator rolls are independently removable for replacement when required.

The foregoing and various other objects of the invention will become evident upon reference to the following detailed description of the preferred embodiment of the invention as illustrated in the accompanying drawings.

DESCRIPTION OF THE PREFERRED EMBODIMENT

Figure 1:
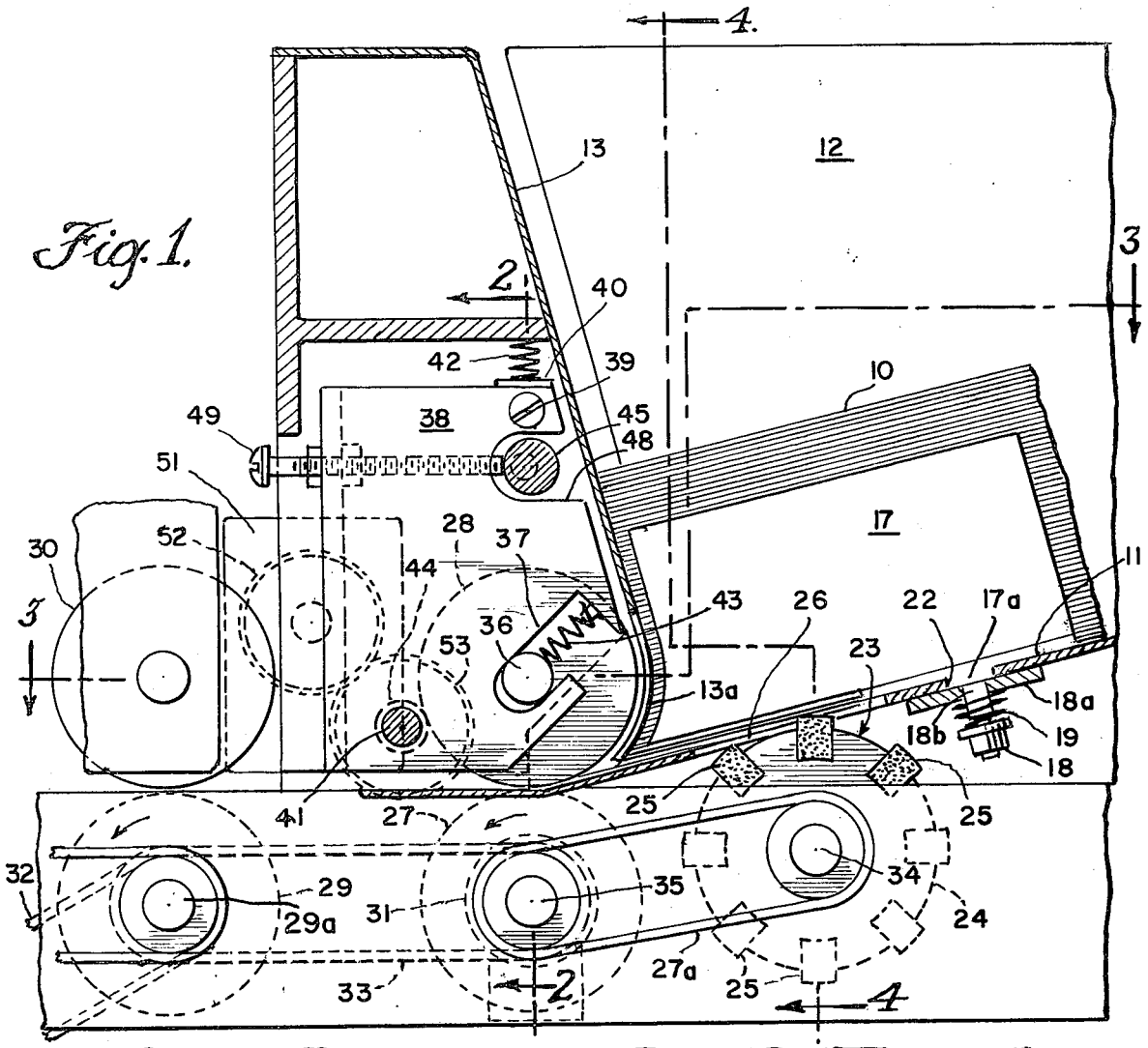
FIG. 1 is an elevational view of a document feeding mechanism incorporating the principals of the present invention.
Figure 4:
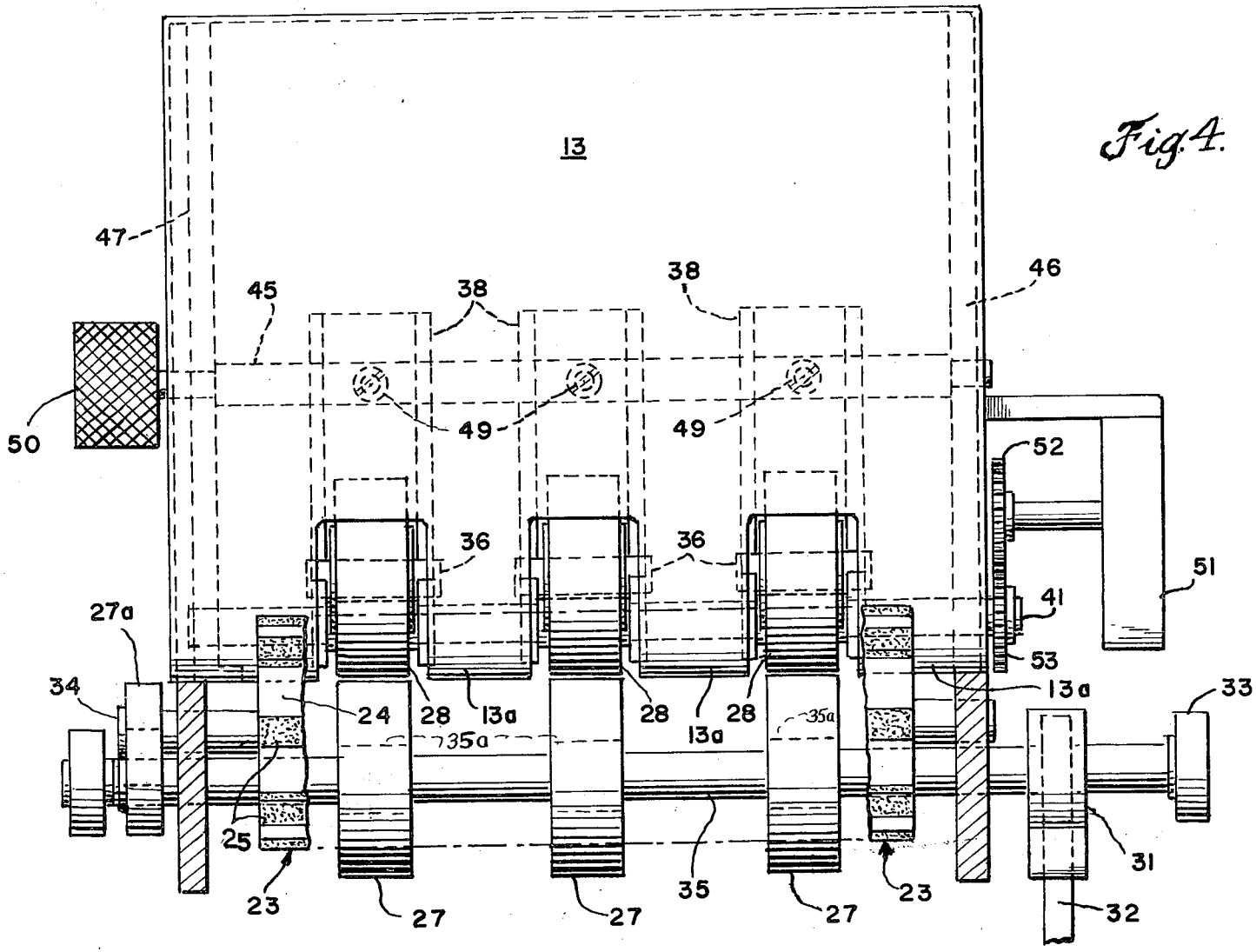
FIG. 4 is a right sectional view of the apparatus of FIG. 1, taken along the lines 4—4.

Attention is first directed to FIG. 1, which shows in elevational view, a stack of documents 10 held in a document hopper or magazine formed of a floor 11, side wall 12 and front wall 13. Front wall 13 has a curved lower portion so that the bottom documents in the stack 10 are displaced towards the left as viewed in FIG. 1. The bottom of front wall 13 is provided with a series of spaced apart cut-away portions so that the curved lower portion is formed into a series of somewhat resilient fingers 13a as also shown in FIG. 4.

Floor 11 is preferably provided with slots 14 (FIG. 3) which expose idler rolls 15 which are freely rotatable on shafts 16. The peripheries of idler rolls 15 project slightly above the plane of bottom plate 11 so as to support the documents in the stack 10 and permit free movement thereby from the stack when the documents are stripped by feed means described hereinafter.

Figure 3:
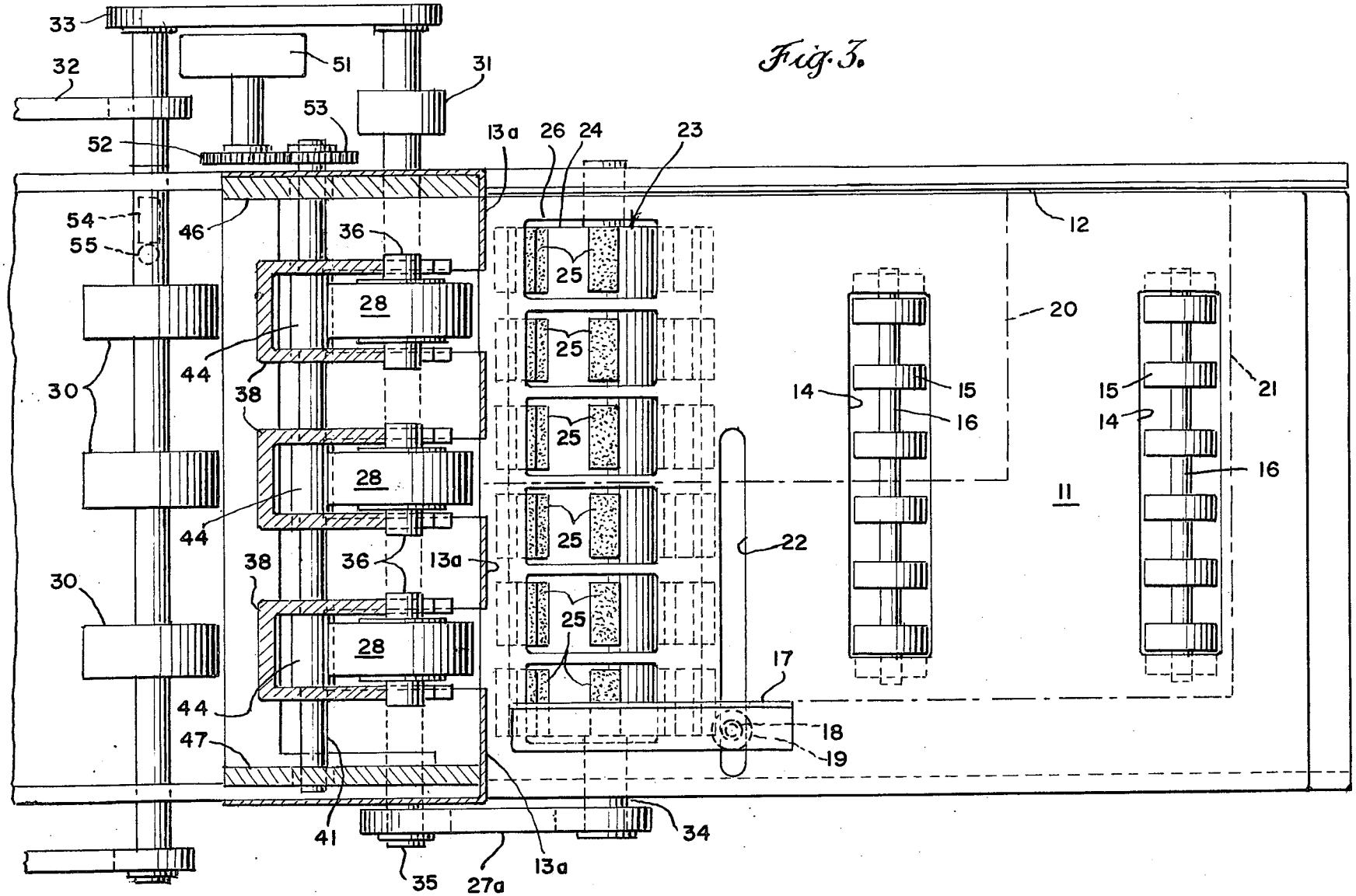
FIG. 3 is a plan sectional view of the apparatus shown in FIG. 1, taken along the lines 3—3 of FIG. 1; and incorporating parts of the apparatus not shown in FIG. 1.

An adjustable side plate 17 shown in FIGS. 1 and 3, is mounted for movement laterally of the stack by means of a depending guide rib 17a which fits within a slot 22. A nut 18 is threaded onto a a stud 18b on which a clamping plate or washer 18a is fitted which clamps the plate in place via a spring 19. Plate 17 confines and guides the documents in the stack and is adjustable laterally so as to permit the feed of documents of varying dimension. Two extreme sizes of documents which the feed mechanism of the illustrative embodiment is intended to feed are shown in broken lines at 20 and 21 in FIG. 3.

Documents fed from the stack are fed serially by feed means comprising pick roll means 23. Preferably pick roll means 23 comprises a plurality of rolls each of which is formed of a low inertia carrier 24 in which spaced apart friction elements 25 are mounted. Elements 25 are formed of a relatively soft material such as urethane rubber. Upon rotation of the pick roll, the elements 25 successively project through gaps 26 in the surface of the bottom plate 11 and contact the surface of the sheet at the end or bottom of the stack, moving the sheet leftwardly as shown in FIG. 1.

Pick roll 24 feeds documents to the left as shown in FIG. 1, by drive means to be described hereinafter, through a gap defined by feed rolls 27 and separator rolls 28. Feed rolls 27 and pick rolls 24, comprising the feed means of the present invention, are adapted to be rotated in unison by means of a belt 27*a*. These rolls thus feed each document through the nip formed between feed rolls 27 and the separator rolls 28 and advance the document until it is picked up by a pair of rolls 29 and 30.

Feed rolls 27 and pick rolls 23 are driven by means including a clutch 31 which is periodically energized by any suitable means. The drive means preferably further comprises a continuously operating electric motor, not shown, which drives rollers 29 via a pair of belts 32. A belt 33 interconnects shafts 29*a*, on which rollers 29 are mounted, with the clutch 31. By energization of the clutch, the pick rolls and feed rolls are rotated for a period of time sufficient to advance a document into the nip formed by the rolls 29 and 30. Rollers 27 are connected to the shaft 35 by over running clutches 35A. When the clutch is de-energized, feed rolls 27 are free to rotate independently of the pick rolls 24 so that there is no frictional drag induced by those rolls once the documents are picked up and advanced by rolls 29 and 30.

During the aforementioned feed cycle, separator rolls 28 are not rotated so that they provide frictional drag on the upper surface of documents as they are fed from the stack. If any document contacted happens to be a document fed simultaneously with another document fed by the pick and feed rolls, the separator rolls prevent the feed of such second document since the coefficient of friction between the rolls and the surface of the document is greater than the coefficient of friction between the two documents.

It should be noted that although the feed means may comprise a single feed and single pick roll, or may comprise a belt-type feeder, it is preferred that a plurality of pick and feed rolls, mounted on common shafts 34 and 35 be provided. An advantage of this arrangement is that floor 11 can extend between the rolls thereby preventing thin documents from wrapping around the rolls as they are fed from the stack. It is also preferred that a separate separator roll 28 be provided for each feed roll 27.

Figure 2:
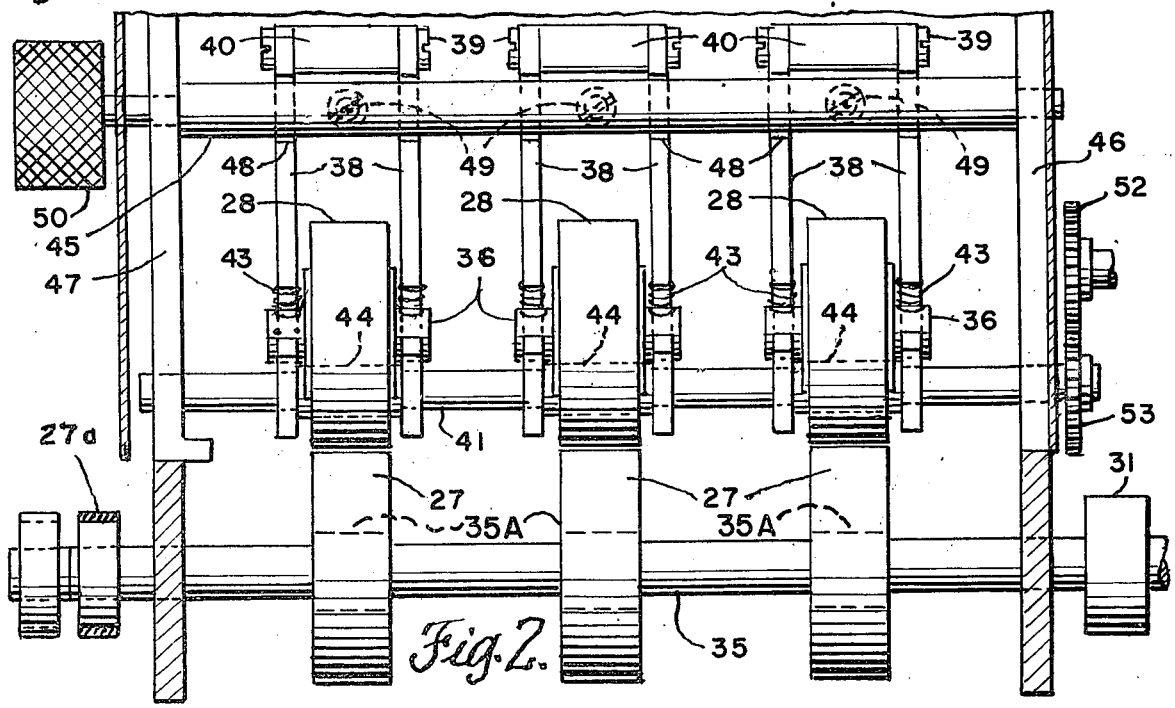
FIG. 2 is a right sectional view of the apparatus shown in FIG. 1, taken along line 2—2 of FIG. 1.

In the illustrative embodiment, each separator roll is mounted on a stub shaft 36. Shafts 36 are in turn mounted in slots 37 in U-shaped carrier brackets 38 which are independently pivotally mounted for rocking movement on shaft 41. At the top of each carrier bracket, as viewed in FIG. 2, cross bars 40 secured to the side members of the bracket by any suitable means such as screws 39. Springs 42 bear against the cross bars 40 and urge the carrier brackets in a clockwise direction. Each of the separator rolls is urged towards the lower end of its inclined slot by means of springs 43. The separator rolls are adapted to bear against the periphery of roller elements 44 secured to the shaft 41. As indicated in FIG. 1, when the separator rolls are installed with their surfaces resting against the surfaces of roller elements 44, the stub shafts 36 are displaced upwardly from the ends of the inclined slots 37. Springs 43 urge the separator rolls against the surface of the rolls 44.

An eccentric shaft 45 is mounted in side frame members 46 and 47 and extends laterally of the apparatus. As viewed in FIG. 1, the shaft 45 fits within notches 48 in the carrier members 38 with sufficient clearance being provided to allow a degree of rocking movement about shaft 41.

In order to adjust the gap between each separator roll and its associated feed roll, adjusting screws 49 are threaded through openings in the back of each carrier member and abut against the surface of eccentric shaft 45. The settings of the adjusting screws 49 thus cause limiting rocking movement of the carrier members about shaft 41 and providing independent adjustment of the distance between each separator roll relative to the feed roll surfaces. In the preferred embodiment, the eccentric shaft 45 is provided with an adjusting knob 50. Adjusting knob 50 is settable by the operator to provide unitary adjustment of all separator rolls relative to their feed rolls once an initial setting of the independent separator rolls has been made. Index marks may be provided adjacent the knob to help the operator adjust the throat gap.

An important feature of the invention is the provision of means to compensate for separator roll wear. A first wear compensation function is the periodic stepping of the separator rolls so as to uniformly distribute wear around the circumference thereof. In the illustrative embodiment, stepping means comprising a stepping motor 51 accomplishes this function. Stepping motor 51 drives each roller 44 via gears 52 and 53, the latter being secured to shaft 41. Preferably rollers 44 advance separator rolls 28 immediately following the feed of each document. In the illustrative embodiment, a photocell 54 and light source 55, such as are schematically indicated in FIG. 3, provide an impulse when the trailing edge of a document passes a read station located at any suitable position, as for example at the nip between rolls 29 and 30. This impulse is applied to the stepping motor which indexes the separator rolls the desired amount during the interval between the feeding of documents via gears 52 and 53, shaft 41 and rollers 44. In the illustrative embodiment, the separator rolls are indexed about 1/32 of an inch between documents. In this manner, wear caused by the wiping of documents against the surface of the relatively soft material of the separator rolls is uniformly distributed about the surface of the rolls.

As indicated above, the wear compensating means also functions to maintain a substantially constant throat gap between separator rolls and feed rolls. As shown in FIG. 1, slots 37 are inclined with respect to the path of travel of documents and the line of centers of the axes of shafts 35 and 36. Rollers 44 secured to shaft 41 constitute wear responsive elements which gradually and continuously cause a shifting of the separator rolls 28 relative to the feed rolls 27 along a path defined by the inclined slots 37. With the arrangement disclosed, as wear is sensed by the rollers 44, the separator rolls are thus shifted in vector paths which roughly follow the curved surfaces of the feed rolls.

In summary, documents are stripped one at a time from the bottom of the stack and fed into the nip between separator rolls 28 and the feed rolls 27. Each document is advanced by the feed means to the point where it is picked up by the rolls 29 and 30 at which time clutch 31 is disengaged and separator rolls 28 are positioned relative to the rolls 27 so as to wipe the upper surface of any documents being fed. If two documents are fed simultaneoudly, the separator rolls function to prevent the feed of the top document due to the high coefficient of friction of the separator rolls and the relatively low coefficient of friction between documents. During the interval between documents an impulse is delivered to stepping motor 51 and the separator rolls are advanced so that the next document contacts a different part of the contact surface of the separator rolls.

As the separator rolls are worn, and the worn surface is sensed by the roller elements 44, the separator rolls are permitted to shift along inclined paths relative to the feed rolls. By means of this arrangement, the distance between each separator roll and the feed roll associated with it remains substantially constant, even though the separator rolls are gradually becoming smaller.

In adjusting the gap between separator rolls and feed rolls, the operator turns the nob 50 to provide a gap approximately equal to the thickness of the thinnest document to be processed. Since the separator rolls and feed rolls are formed of a relatively soft yieldable material, somewhat thicker documents can be accommodated. For example, it has been found that documents ranging in thickness from 2 mils to 7 mils will be accepted by the apparatus without a change in the setting of adjustment knob 50.

We claim:

1. Mechanism for feeding sheets from a stack comprising moveable sheet feed means located adjacent one end of said stack, sheet separator roll means having a sheet contacting surface spaced from said feed means by an amount providing a throat gap through which sheets are fed, said feed means having a coefficient of friction on its sheet contacting surface which is higher than the coefficient of friction of the sheet contacting surface of the separator roll, said feed means being engageable with the exposed side of each sheet at the end of the stack and being moveable in a sense which serially advances sheets through said throat gap, said separator roll being operable to retard the feed of a second sheet fed substantially simultaneously with the sheet being advanced by said feed means, wear compensating means for said separator roll means comprising means mounting said separator roll means for movement along a path which is inclined with respect to the feed means and a wear sensing member positioned in engagement with the card contacting surface of the separator roll means in position so that movement of the separator roll means along the inclined path is limited, and wherein the point of contact for said wear sensing element with the card contacting surface of the separator roll is spaced from said inclined path on the side of the path away from the throat gap.

2. Mechanism according to claim 1 wherein said mounting means provides for movement of the separator roll along a path in which its rotative axis approaches but does not intersect the surface of said rotary feed member.

3. Mechanism according to claim 1 wherein said wear compensating means further includes indexing means connected to said wear sensing member for and being operable to move said wear sensing member to cause limited rotational movement to said separator roll whereby wear is distributed over the circumference of said separator roll.

4. Mechanism according to claim 1 wherein said separator roll means comprises a plurality of separator rolls independently mounted in side-by-side relationship, and further including means for adjusting all of said separator rolls as a unit relatively to said feed roll.

5. In a sheet feeding device comprising feed means including a feed roll for serially feeding sheets from a stack, a separator roll disposed adjacent said feed roll and spaced therefrom to form a gap substantially equal to the thickness of a single sheet, said separator roll having a yieldable surface having a relatively high coefficient of friction engageable with the sheets, a roller in contact with the surface of the separator roll for rotatively adjusting said separator roll when the sheets are not in frictional contact therewith to distribute wear over the high friction surface, said roller being angularly displaced from a line extending through the centers of the separator roll and the feed roll, and means mounting said separator roll for shifting movement relatively to the feed roll comprising a guide for constraining the separator roll movement along a path which permits the surface to angularly approach the surface of the feed roll.

6. Apparatus according to claim 5 wherein the feed roll path extends along a line which passes intermediate said roller and said gap.

* * * * *